US009873989B2

(12) United States Patent
Emge et al.

(10) Patent No.: US 9,873,989 B2
(45) **Date of Patent: *Jan. 23, 2018**

(54) FIBER FOR SYNTHETIC GRASS FIELD

(71) Applicant: TARKETT INC., Farnham (CA)

(72) Inventors: Thorsten Emge, Rodgau (DE); Jurgen Morton-Finger, Weinheim (DE)

(73) Assignee: TARKETT INC., Farnham, Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/677,684

(22) Filed: Apr. 2, 2015

(65) Prior Publication Data

US 2015/0211193 A1 Jul. 30, 2015

Related U.S. Application Data

(63) Continuation of application No. 13/192,004, filed on Jul. 27, 2011, now Pat. No. 9,005,723.

(60) Provisional application No. 61/411,899, filed on Nov. 9, 2010.

(51) Int. Cl.

| | |
|---|---|
| ***E01C 13/08*** | (2006.01) |
| ***D02G 3/34*** | (2006.01) |
| ***D01D 5/253*** | (2006.01) |

(52) U.S. Cl.

CPC ..... *E01C 13/08* (2013.01); *D01D 5/253* (2013.01); *D02G 3/34* (2013.01); *Y10T 428/23929* (2015.04); *Y10T 428/23936* (2015.04); *Y10T 428/2976* (2015.01); *Y10T 428/2978* (2015.01)

(58) Field of Classification Search

CPC ..... D02G 3/34; D02G 3/44; D02G 3/445; D01D 5/253; Y10T 428/2913; Y10T 428/2933; Y10T 428/23929; Y10T 428/23936; Y10T 428/2973; Y10T 428/2976; Y10T 428/2978; E01C 13/08; E01C 2013/086; Y10S 273/13

USPC ..... 428/15, 17–22, 88, 89, 92, 97, 357, 364, 428/401

See application file for complete search history.

(56) References Cited

U.S. PATENT DOCUMENTS

| | | | |
|---|---|---|---|
| 2,931,089 | A | 4/1960 | Evans |
| 3,346,916 | A | 10/1967 | Elbert et al. |
| 3,837,980 | A | 9/1974 | Nishimura et al. |
| 3,940,522 | A | 2/1976 | Wessells |
| 4,408,977 | A | 10/1983 | Phillips |
| 6,432,505 | B1 | 8/2002 | Sweenie et al. |
| 6,491,991 | B2 | 12/2002 | Seaton |
| 7,611,763 | B2 | 11/2009 | Atsma et al. |

(Continued)

FOREIGN PATENT DOCUMENTS

| | | |
|---|---|---|
| CN | 2844201 Y | 12/2006 |
| DE | 102004013749 | 8/2005 |

(Continued)

OTHER PUBLICATIONS

The Global Artificial Grass Market 2007, AMI Consulting, Applied Marketing Information Ltd., pp. 1-3, 33-37, Feb. 2008.

(Continued)

*Primary Examiner* — Frank J Vineis
(74) *Attorney, Agent, or Firm* — Winston & Strawn LLP

(57) ABSTRACT

A filament for use in an artificial grass field, wherein the filament has a front and a back surface and at least one of the front surface and back surface includes a plurality of adjacent concave indentations extending generally from a first end to a second end.

16 Claims, 8 Drawing Sheets

(56) References Cited

U.S. PATENT DOCUMENTS

| | | | |
|---|---|---|---|
| 7,632,444 | B2 | 12/2009 | Stroppiana |
| 2006/0003653 | A1 | 1/2006 | Hart, Sr. et al. |
| 2006/0093783 | A1 | 5/2006 | De Clerck et al. |
| 2009/0098378 | A1 | 4/2009 | Spaans et al. |
| 2013/0004683 | A1 | 1/2013 | Auguste et al. |

FOREIGN PATENT DOCUMENTS

| | | | |
|---|---|---|---|
| EP | 0 648 868 | A1 | 4/1995 |
| EP | 0 858 769 | B1 | 8/1998 |
| EP | 1 828 449 | B1 | 5/2007 |
| EP | 1950 350 | A1 | 7/2008 |
| EP | 1 837 423 | A1 | 9/2009 |
| EP | 2 284 318 | A1 | 2/2011 |
| ES | 2 336 760 | | 4/2010 |
| GB | 1166361 | | 10/1969 |
| GB | 1390338 | | 4/1975 |
| JP | S5024871 | U | 3/1975 |
| JP | S52165981 | U | 12/1977 |
| JP | 4 011005 | A | 1/1992 |
| JP | H06330430 | A | 11/1994 |
| JP | 9111532 | A | 4/1997 |
| JP | 2001-248013 | A | 9/2001 |
| KR | 101989002109 | B1 | 6/1989 |
| KR | 1020090041781 | A | 4/2009 |
| KR | 1020090041783 | A | 4/2009 |
| KR | 20100073706 | A | 7/2010 |
| KR | 101357683 | B1 | 2/2014 |
| WO | WO84/00179 | A1 | 1/1984 |
| WO | WO01/61110 | A1 | 8/2001 |
| WO | WO2001/061110 | A1 | 8/2001 |
| WO | WO2005/005731 | A2 | 1/2005 |
| WO | WO2006/085751 | A1 | 8/2006 |
| WO | WO 2008/077559 | A1 | 7/2008 |
| WO | WO2009/005375 | A1 | 1/2009 |
| WO | WO2011/006878 | A1 | 1/2011 |

OTHER PUBLICATIONS

End-user Focused Innovation in Synthetic Turf, Presentation Bonar Yarns, AMI Conference The Grass Yarn & Tufters Forum 2009, Barcelona, (22 pages) Feb. 3, 2009.

Dr. Ing. Ulrich Berghaus, Innovative extrusion technology for the production of premium artificial grass, Presentation Reimotec, Maschinen-und Anlagenbau GmbH, AMI Conference The Grass Yarn & Tufters Forum 2009, Barcelona, pp. 1-31, Feb. 2009.

Presentation of Bonar Yarns to Lano, (20 pages) Mar. 2009.

Presentation of Bonar Yarns to Tiger Turf, pp. 1-8 Oct. 2008.

Presentation of Bonar Yarns to Sekisui, pp. 1-12, Nov. 2008.

Presentation of Bonar Yarns to customers, pp. 1-5, 1-5 (2008).

Customer (Domenech Hermanos S.A.) Invoices for deliveries of BonaFil C-shape, (9 pages) and Jun. 2008 to Mar. 2009.

Customers Invoices for deliveries of Bonaspine, (14 pages) Apr.-Jul. 2009.

Product Information Sheet BonaSpine, Product Information, BonarYarns,Low & Bonar PLC (1 page) info@bonaryarns.com.

Merriam-Webster, S Curve, <www.merriam-webster.com/dictionary/s curve>, accessed Jun. 25, 2014.

Merriam-Webster, encompass, <www.merriam-webster.com/dictionary/s curve>, accessed Jun. 25, 2014.

Dictionary.com, peak, <http://dictionary.reference.com/browse/peak?s=t>, accessed Jun. 25, 2014.

Sportexe.com, Turf WorkBook, 2007, http://www.niaaa.org/assets/NIAAA-Turf-Workbook.pdf, accessed Aug. 19, 2013.

Dictionary.com, Concave, May 28, 2013.

Mondo, Sports Turf Brochure, available at: http://wWw.mondoworldwide.com/download.cfm? versioneuid=914A6D7A-5056-8F31-5576AE679F3A57DD &nomedocumento=Sport%5FTurf%5FBrochure%5Fen% 1 2Epdf.

Domo Sports, Product Brochure, available at: http://www.domosportsgrass.com/artificial-grass-soccer-ascari-supremH-18-5-en. html#heliflex.

Desso, Product Brochure, available at: http://www.1stturf.com/pdfs/iDNA.pdf.

Feb. 8, 2012 Search Report and Written Opinion for PCT/EP2011/005473 (filed Oct. 28, 2011).

FIBER FOR SYNTHETIC GRASS FIELD

CROSS REFERENCE TO RELATED APPLICATIONS

This is a continuation application of U.S. non-provisional application Ser. No. 13/192,004, filed Jul. 27, 2011, which claims the benefit of U.S. provisional application No. 61/411,899, filed Nov. 9, 2010. The content of each prior application is expressly incorporated herein by reference thereto.

FIELD OF THE INVENTION

The invention relates to a fiber/filament for a synthetic grass field.

BACKGROUND OF THE INVENTION

Synthetic grass fields (or artificial turf) have been used for years to provide a surface that simulates natural grass. These synthetic grass fields have many benefits over natural grass and, in addition, can be installed and used in places that do not allow for natural grass fields.

One type of synthetic grass field that is commonly used is an infilled synthetic grass field. The infilled synthetic grass field includes a plurality of fibers (also referred to as filaments or ribbons), wherein the fibers are operatively attached to a backing member. Typically the fibers are tufted through the backing member. In most instances, once the backing member (with fibers) is installed on a substrate or other supporting surface, an infill material (typically, rubber, sand or a mixture thereof) is installed to support the fibers in an upright position.

The fibers must be durable enough to withstand the impact and forces imparted thereon during the use of the synthetic grass field. The fibers should also have sufficient structural strength so that at least the exposed portions of some of the fibers can extend above the infill (as opposed to laying flat thereon).

For a synthetic grass field located outside, the fibers should also be able to withstand the forces of nature that act thereon (i.e., have sufficient "weatherability").

In addition to having sufficient weatherability and being sufficiently durable, the fibers should not be too abrasive that it could injure users of the synthetic grass field.

Furthermore, it is usually desirable that the fibers simulate the look of natural grass.

Conventional fibers utilize various shapes and geometries to provide for these and other considerations.

For example, U.S. Pat. No. 6,491,991 discloses a spinneret used to make fibers for artificial turf. The fibers have a series of increasingly larger bulbs (as the bulbs approach the middle). While presumably effective for its intended purpose, such a fiber is believed to be prone to fray, as the intersections where the bulbs meet form weak points. Moreover, the convex bulbs are believed to transfer the physical forces to these intersection points, which add to the proneness of such a fiber to fray.

Japanese Patent Application No. JP9111532A discloses another fiber, similar to those in the '991 patent, comprising a series of bulbs. Again, it is believed that such a fiber is more prone to fraying along the intersection points between bulbs.

EP 1 950 350 A1 discloses various fibers, some of which have bulbs at the center and on the ends. These fibers have stress points at the point the bulbs are connected to the fiber.

As a result, these types of fibers have a tendency to fray or split along these stress points.

A further fiber is disclosed in WO 2011/006878 which is a curved or "sickle-shaped" cross section. The fiber also includes a plurality of ridges arranged along the longitudinal direction of the grass yarn. Such a fiber has a series of flat sections between the ridges, which is believed to make the fiber appear less like natural grass. Moreover, since the ridges protrude out of the body of the fiber, it is believed that they increase the thickness of the fiber which can make the fiber too stiff and not desirable for certain applications.

The present invention is directed to providing a fiber having a shape and geometry that attempts to adequately balance each of these considerations.

SUMMARY OF THE INVENTION

In one embodiment, the invention relates to a fiber for use in an artificial grass field having a first end and a second end, a center portion and two wing portions extending from the first end to the second end, a front surface and a back surface.

The use of the term "fiber" is meant to be interchangeable with the term "filament," as would be appreciated by one of ordinary skill in the art.

At least one of the front surface and back surface includes a plurality of adjacent concave indentations.

In another preferred embodiment of the invention the wing portions are curved.

In yet another embodiment of the invention each wing portion includes an end forming an edge of the filament opposite the center portion and wherein the ends of the wing portions have a thickness less than the thickness of the center portion.

In still another embodiment of the invention the adjacent concave indentations extend from the first end of the fiber to the second end of the fiber.

While in another embodiment of the invention the adjacent concave indentations extend from the first end to a point between the first end and the second end.

In yet another embodiment of the invention the front surface includes the adjacent concave indentations and the back surface is smooth.

While in another embodiment both the front surface and the back surface include the adjacent concave indentations.

In another embodiment, the adjacent concave indentations are differently sized. In a further embodiment, the adjacent concave indentations have the same size. It is also contemplated that the concave indentations at the center portion are larger than the concave indentations on the wing portion.

In still another embodiment, the edges of the ends are smooth and do not include any concave indentations.

A fiber in accordance with one or more embodiments of the present invention is believed to provide numerous advantageous in artificial turf fields.

First, the present invention provides a look that more closely resembles natural grass.

Light is reflected off of the surface at the angle at which it hits the surface. Some conventional fibers have lengths of relatively straight sections that produce a "glossy" look. The present invention, and more particularly the adjacent concave indentations, provides a surface that "scatters" the light, producing a "matted" look. This "matted" look is believed to more closely resemble the look of natural grass.

In addition, the present invention is believed to provide a more durable fiber by minimizing or eliminating stress points, and by redirecting forces out of the geometry of the fiber.

Some conventional fibers have centers and/or ends that include a bulb, a series of bulbs, or other similar projections (from a cross sectional view these projections resemble bulbs). As discussed above, these fibers have stress points where the bulbs are connected to the fiber/each other. As a result, these types of fibers have a tendency to fray or split along these stress points. The present invention, on the other hand, does not include these bulbs, and conversely does not include the stress points. However, despite the lack of splines, or bulbs, the fiber according to the present invention is able to have sufficient strength to stand up and resemble grass.

A testing of the flexural strength of a fiber in accordance with the present invention exhibited a 23% advantage as compared to a conventionally used fiber.

Fibers according to the present invention may be made according to any number of conventionally available methods. One such method may be the following steps: extruding the fiber; stretching the fiber; annealing the fiber; and, winding the fiber. One of ordinary skill in the art will appreciate that the fiber can be made through other methods of manufacture.

Furthermore, a fiber according to the present invention can be made with any number of polymers. It is preferred that the polymers have low skin abrasion to accommodate comfort and safety of the user. The polymers should also preferably be sufficiently durable to withstand the mechanical wear and forces subjected to the fibers. Further, the polymers should have sufficient weatherability to accommodate UV rays, rain and heat.

It is to be understood that the aspects and objects of the present invention described above may be combinable and that other advantages and aspects of the present invention will become apparent upon reading the following brief description of the drawings and detailed description of the invention.

BRIEF DESCRIPTION OF THE DRAWINGS

The present invention will become more fully apparent from the following description and appended claims, taken in conjunction with the accompanying drawings. Understanding that the accompanying drawings depict only typical embodiments, and are, therefore, not to be considered to be limiting of the scope of the present disclosure, the embodiments will be described and explained with specificity and detail in reference to the accompanying drawings as provided below.

DETAILED DESCRIPTION OF THE DRAWINGS

Figure 1:
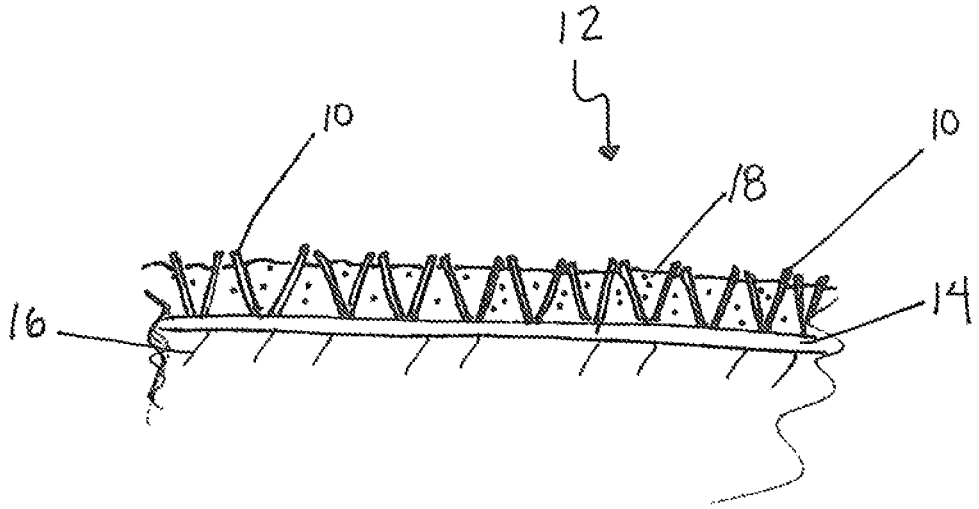
FIG. 1 is a side perspective view of an infilled artificial turf system.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Reference throughout this description to features, advantages, objects or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

According to an embodiment of the present invention, and as shown in FIG. 1, the present invention is directed to a fiber 10 for use in an artificial grass field 12. More particularly, the artificial grass field 12 includes a backing member 14 upon a foundation 16.

The fibers 10 are functionally connected to the backing member 14. Preferably, the fibers 10 are tufted through the backing member 14. In addition, an adhesive, heat sealing, epoxy, glue or other means of attaching the fibers 10 to the backing member 14 may be utilized.

Disposed between the fibers 12 and on top of the backing member 14 is generally a particulate infill 18. The particulate infill 18 can be rubber, sand, a mixture thereof, or any number of known products used for the particulate infill 18.

Figure 2:
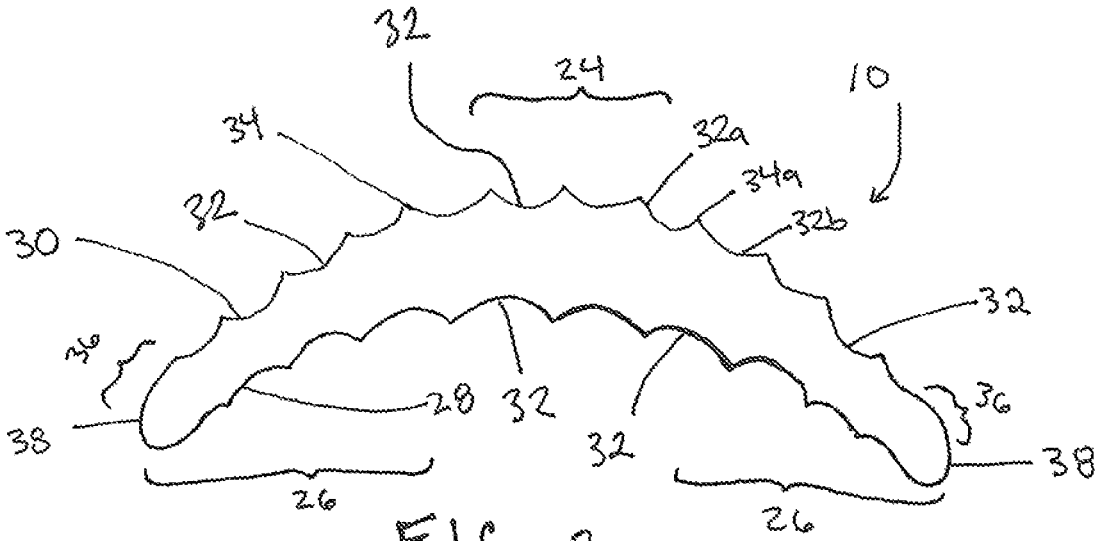
FIG. 2 is a top cutaway view of a fiber according to an embodiment of the present invention.
Figure 3:
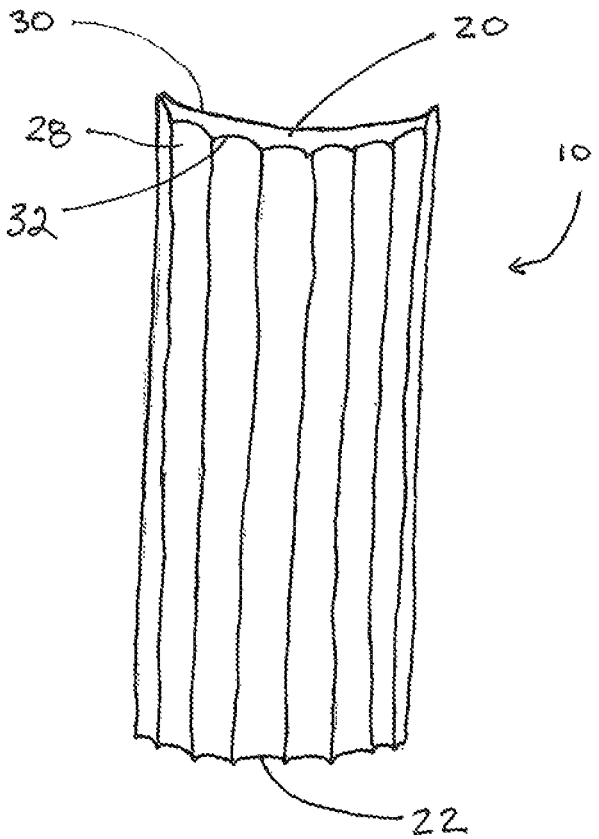
FIG. 3 is a front perspective view of a fiber according to an embodiment of the present invention.
Figure 4:
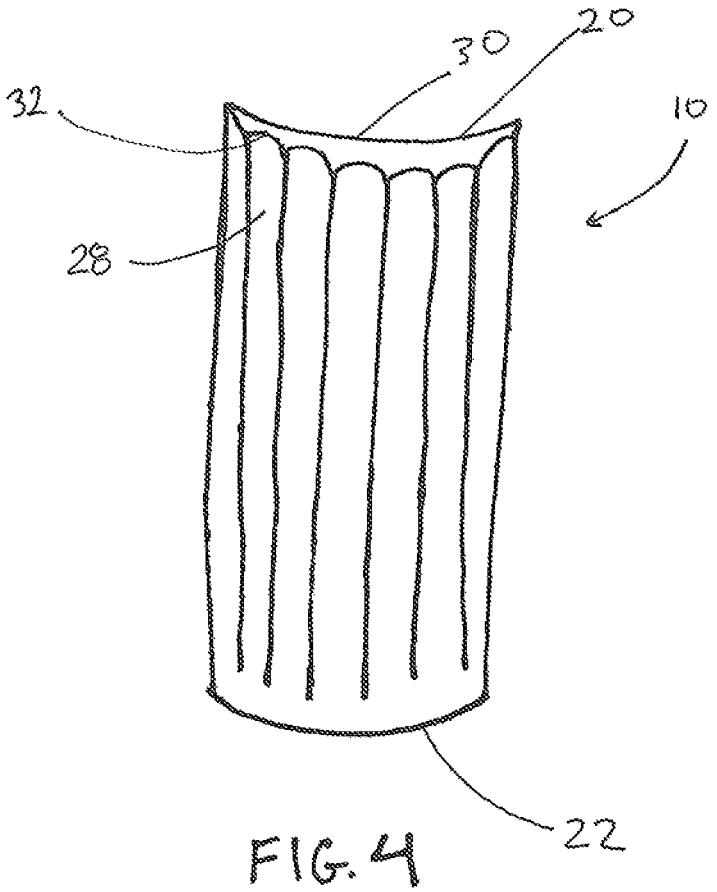
FIG. 4 is another front perspective view of a fiber according to an embodiment of the present invention.
Figure 5:
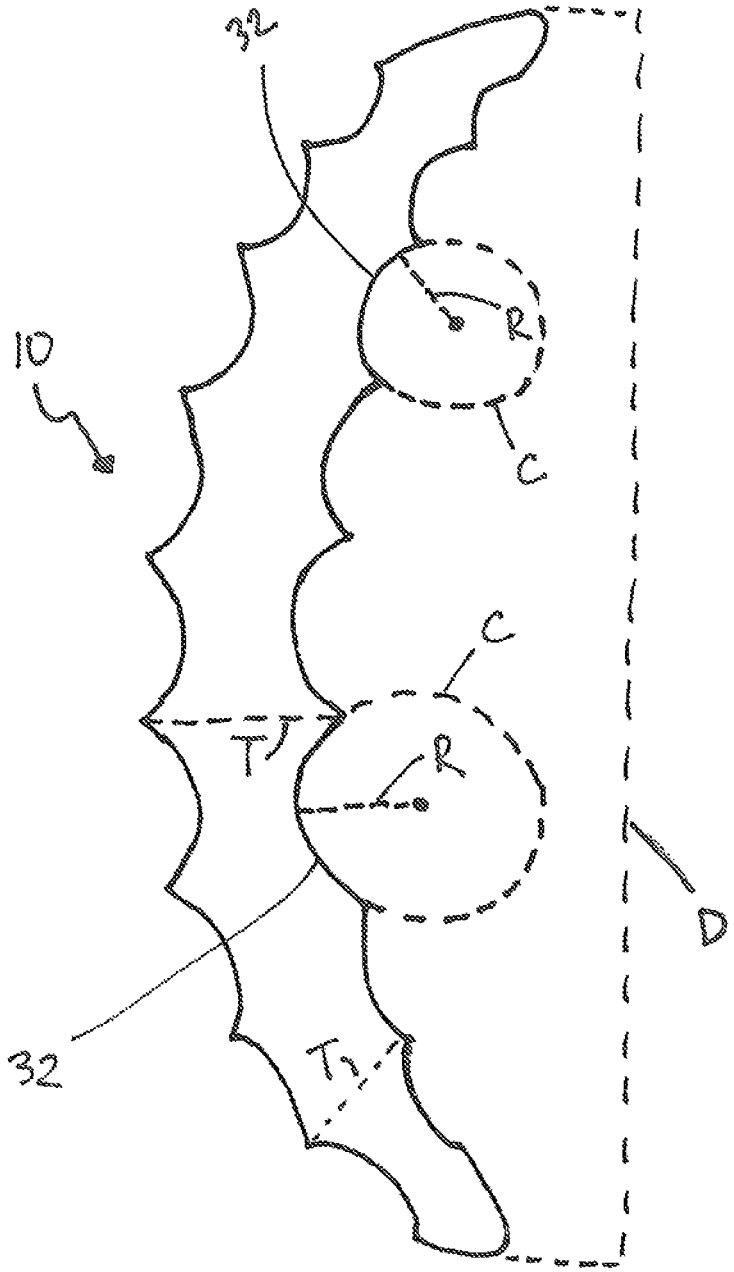
FIG. 5 is another top cutaway view of a fiber according to an embodiment of the present invention.

As can be seen in FIGS. 2 and 3, the fiber 10 generally includes a first end 20 and a second end 22, a center portion 24 and two wing portions 26. The wing portions 26 extend from the first end 20 to the second end 22 and are generally parallel to the center portion 24. The fiber 10 also includes a front surface 28 and a back surface 30. In an embodiment of the invention, at least one of the front surface 28 and back surface 30 includes a plurality of adjacent concave indentations 32. The concave indentations 32 may extend from the second end 22 to the first end 20, or alternatively, may only extend over a portion of the front surface and/or back surface, i.e., from the first end 20 to a point between the first end 20 and the second end 22. See, FIG. 4.

By the term "adjacent" it is meant that a peak 34 is shared between two concave indentions 32 disposed next to each other. For example, the two concave indentations 32*a*, 32*b* are disposed next to each other and both share peak 34*a*. Moreover, as used herein "peak" is meant to encompass or mean a connecting relationship between adjacent concave indentations wherein one concave indentation transitions into another concave indentation in a relatively short distance (for example, less than 10% of the width of the concave indentation).

It is contemplated that the concave indentations 32 have different sizes, for example, those on the center portion 24 may be larger in size than those on the wing portions 26. One method of measuring the size of the various concave indentations 32 is to determine the radius R of a circle C on which the individual concave indentations 32 would be positioned. In this method, the concave indentions 32 on the wing portions 26 may have a radius of approximately 60 micrometers, while the concave indentations 32 on the center portion 24 may have a radius of approximately 110 micrometers. Of course other radii, as would be appreciated by those with ordinary skill in the art having the present disclosure before them, are also contemplated by the present invention.

Alternatively, the concave indentations 32 may be the same size (i.e., have the same radius, preferably between approximately 60 micrometers to approximately 130 micrometers). By the "same" or "same size" it is recognized that due to the small size, minor deviations in the size of the concave indentations may occur (for example about 5% difference), and still fall within the meaning of "same size."

In the fiber 10 shown in FIG. 2, both the front and back include a plurality of adjacent concave indentations 32. Alternatively, as shown in FIG. 3, a fiber 10 is depicted wherein only the front surface 28 has a plurality of adjacent concave indentations 32. In other words, in one embodiment, the fiber 10 has a front surface 28 having a first texture and a back surface 30 having a second texture, and the first texture and second texture are different.

As discussed above, the fiber 10 also includes wing portions 26, which may be curved. This is sometimes referred to as a "bat wing" configuration, wherein the wing portions 26 are not linear with respect to each other or the center portion 24.

In a further embodiment of the invention, each wing portion 24 includes ends 36 each of which forms and edge 38 of the filament 10 opposite the center portion 24. The ends 36 may have a thickness less than a thickness of the center portion 24. Thus, if a fiber 10 has a center portion 24 with a thickness T of approximately 250 micrometers, the ends 36 may have a thickness of less than approximately 250 micrometers. In an embodiment, the distance D between the edges 38 is approximately 1320 micrometers.

It is contemplated that the ends 36 and the edges 38 may be smooth and will not include any concave indentations. In a preferred embodiment the edges 38 are rounded.

In FIGS. 6-9 various embodiments of the present invention are identified showing specific measurements. Although these drawings (FIGS. 6-9) are schematically shown, the following information represents actual measurements of physical samples of various embodiments of the present invention.

Figure 6:
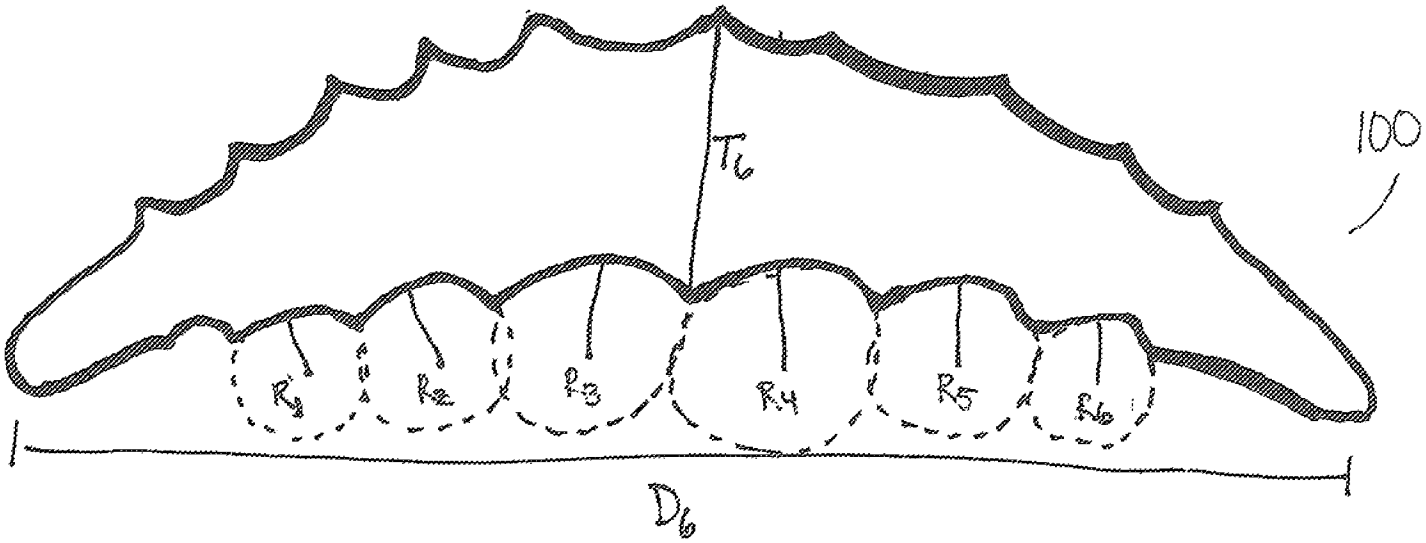
FIG. 6 is a top cutaway view of a fiber according to an embodiment of the present invention.

In FIG. 6, the fiber 100 has a thickness $T_6$ of 249.70 micrometers and a distance $D_6$ between edges of 1326.88 micrometers. The size of the indentations was measured by calculating the radii of the circles associated with each individual indentation. The following measurements were obtained: $R_1$ 86.25 micrometers; $R_2$ 107.87 micrometers; $R_3$ 112.19 micrometers; $R_4$ 110.84 micrometers; $R_5$ 110.84 micrometers; and $R_6$ 115.81 micrometers.

Figure 7:
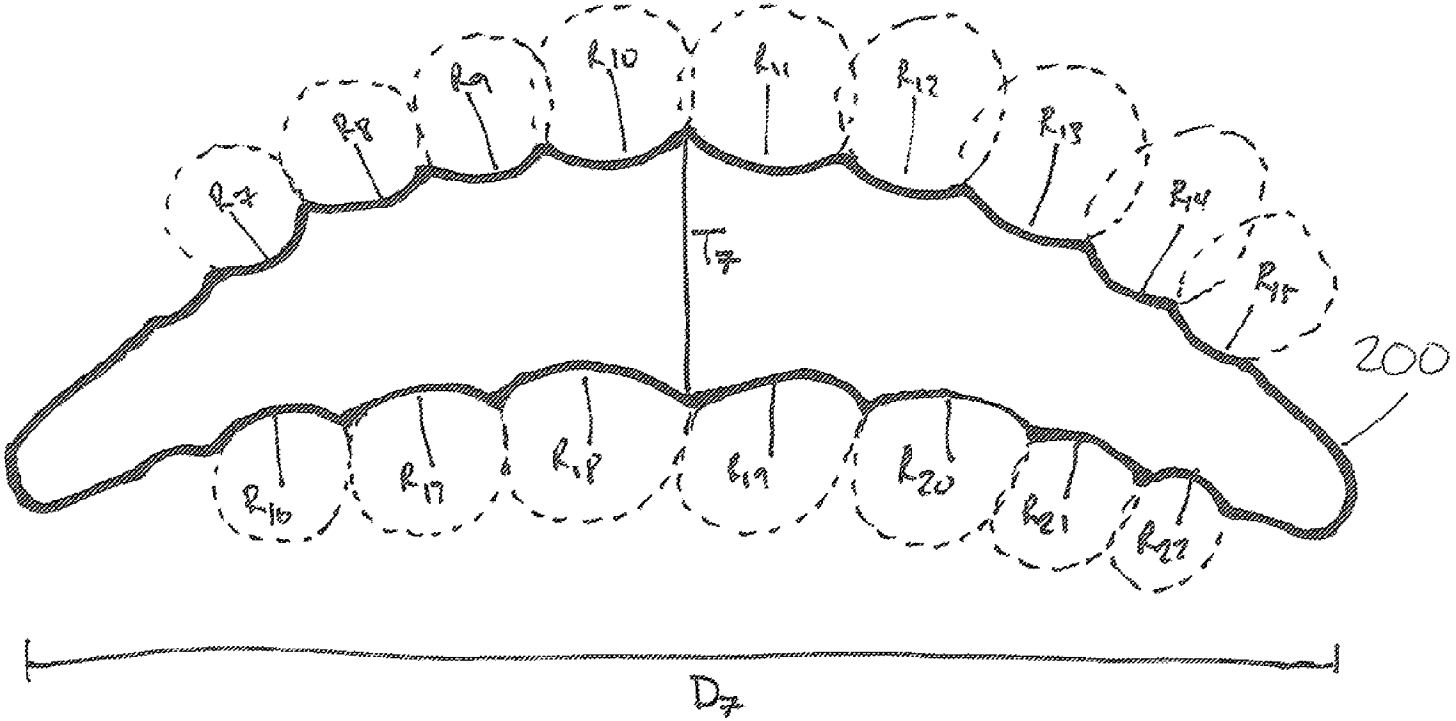
FIG. 7 is a top cutaway view of a fiber according to an embodiment of the present invention.

In FIG. 7, the fiber 200 had a thickness $T_7$ of 245.39 micrometers and a distance $D_7$ between edges of 1327.78 micrometers. Again, the size of the indentations was measured according to the radii of the circles, with the following results: $R_7$ 61.99 micrometers; $R_8$ 95.98 micrometers; $R_9$ 98.95 micrometers; $R_{10}$ 106.66 micrometers; $R_{11}$ 92.88 micrometers; $R_{12}$ 86.87 micrometers; $R_{13}$ 86.12 micrometers; $R_{14}$ 99.31 micrometers; $R_{15}$ 106.71 micrometers; $R_{16}$ 93.86 micrometers; $R_{17}$ 32.67 micrometers; $R_{18}$ 131.73 micrometers; $R_{19}$ 130.65 micrometers; $R_{20}$ 130.17 micrometers; $R_{21}$ 105.47 micrometers; and $R_{22}$ 59.880 micrometers.

Figure 8:
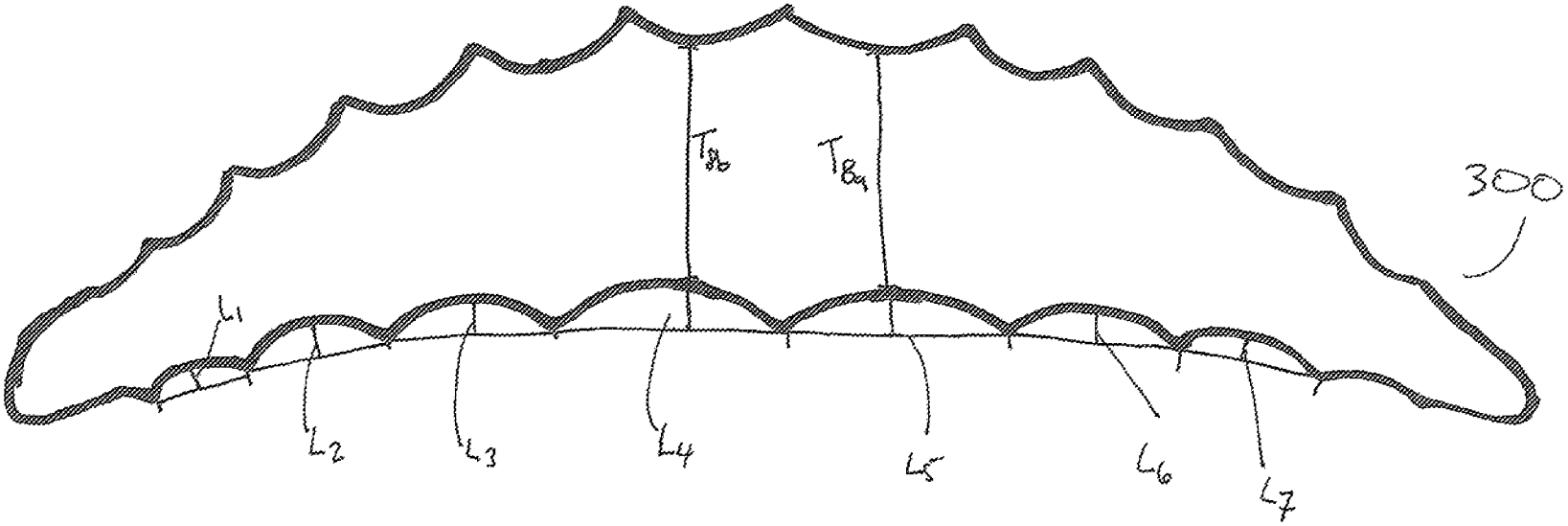
FIG. 8 is a top cutaway view of a fiber according to an embodiment of the present invention.

In FIG. 8, the thickness $T_{8a}$, $T_{8b}$ was measured to be 193.69 micrometers and 195.09 micrometers, respectively. This distance was obtained by measuring the distance between the low points of indentations on the front side and the back side. Moreover, the sizes of the indentations in fiber 300 were measured by calculating the distance L from the bottom of the indentation to a line connecting the peaks bordering the indentation. The following measurements were obtained: $L_1$ 16.30 micrometers; $L_2$ 30.80 micrometers; $L_3$ 36.26 micrometers; $L_4$ 43.66 micrometers; $L_5$ 43.89 micrometers; $L_6$ 36.94 micrometers; and $L_7$ 31.66 micrometers.

Figure 9:
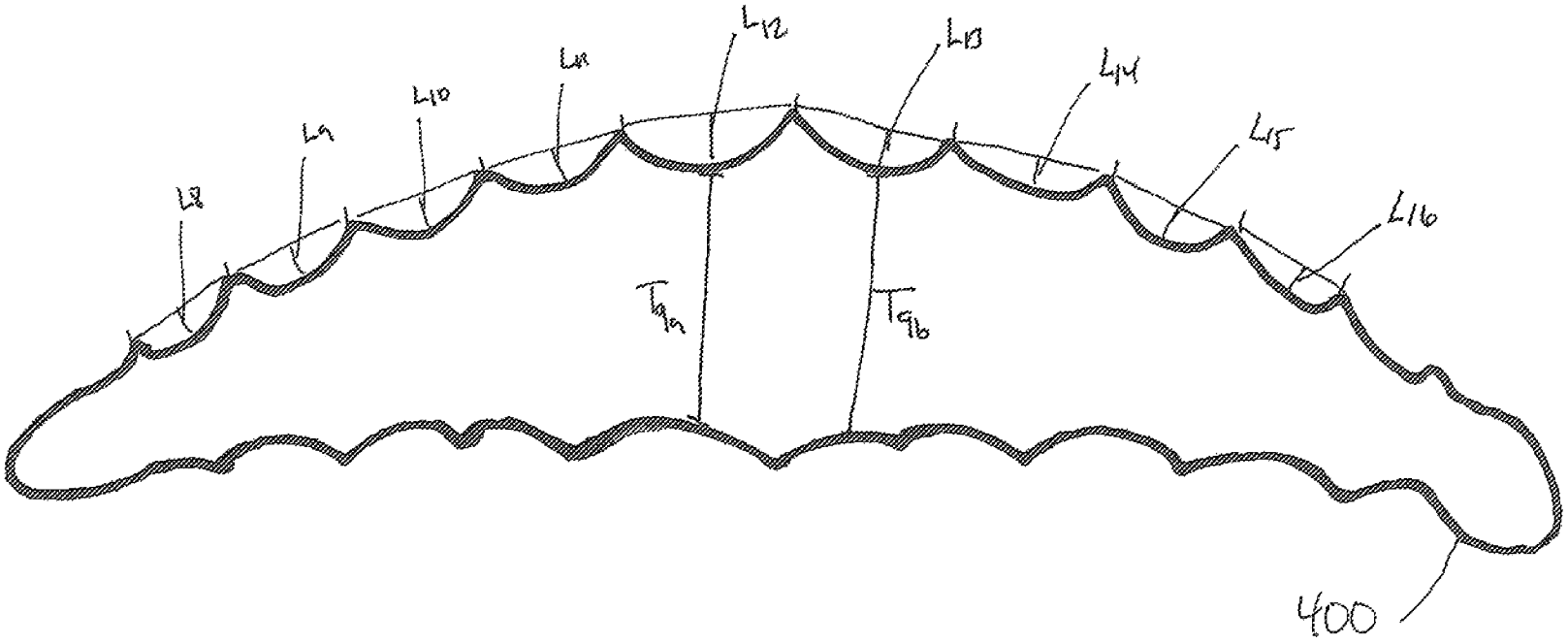
FIG. 9 is a top cutaway view of a fiber according to an embodiment of the present invention.

The same methods of calculating the distances and sizes used in FIG. 8 were used to measure fiber 400 in FIG. 9. This resulted in thickness $T_{9a}$, $T_{9b}$ measures of 214.94 micrometers and 211.62 micrometers, respectively. The sizes of the indentations were as follows: $L_8$ 17.70 micrometers; $L_9$ 19.03 micrometers; $L_{10}$ 23.72 micrometers; $L_{11}$ 23.37 micrometers; $L_{12}$ 25.97 micrometers; $L_{13}$ 28.54 micrometers; $L_{14}$ 22.50 micrometers; $L_{15}$ 23.05 micrometers; and, $L_{16}$ 20.58 micrometers.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A filament for use in an artificial grass field comprising:
- a first end and a second end;
- two wing portions extending from the first end to the second end;
- a center portion between the two wing portions and extending from the first end to the second end; and
- a front surface, wherein the front surface includes a plurality of adjacent concave indentations, wherein the concave indentations extend only from the first end to a point between the first end and the second end, and wherein adjacent concave indentations share a peak.

2. The filament of claim 1, wherein the wing portions are curved.

3. The filament of claim 1, wherein each wing portion includes an end forming an edge of the filament spaced from the center portion and wherein the ends of the wing portions have a thickness less than a thickness of the center portion.

4. The filament of claim 1 wherein the concave indentations at the center portion are larger than the concave indentations on the wing portions.

5. A filament for use in an artificial grass field comprising:
- a first end and a second end;
- a center portion and two wing portions extending from the first end to the second end;
- a front surface, wherein the front surface includes a plurality of adjacent concave indentations, wherein adjacent concave indentations meet at a vertex, and wherein a plurality of concave indentations are on the first wing portion and a plurality of concave indentations are on the second wing portion, and the two wing portions are nonlinear.

6. A filament of claim 5, wherein the wing portions are curved.

7. A filament of claim 5, wherein each wing portion includes an end forming an edge of the filament spaced from the center portion and wherein the ends of the wing portions have a thickness less than a thickness of the center portion.

8. A filament of claim 5, further comprise a back surface including a plurality of adjacent concave indentations.

9. A filament of claim 8, wherein adjacent concave indentations on the back surface meet at a vertex, and wherein a plurality of concave indentations on the back surface are on the first wing portion and a plurality of concave indentations on the back surface are on the second wing portion.

10. The filament of claim 8, wherein the concave indentations on the back surface at the center portion are larger than the concave indentations on the back surface at the wing portions.

11. The filament of claim 5, wherein the concave indentations at the center portion are larger than the concave indentations on the wing portions.

12. The filament of claim 5, wherein the concave indentations extend from the first end to the second end.

13. The filament of claim 5, wherein the concave indentations extend from the first end to a point between the first end and the second end.

14. A filament for use in an artificial grass field comprising:

a first end and a second end;

a center portion and two wing portions extending from the first end to the second end; and a front surface, wherein the front surface includes a plurality of adjacent concave indentations and the adjacent concave indentations meet at a vertex;

a back surface, wherein the back surface includes a plurality of adjacent concave indentations and the adjacent concave indentations meet at a vertex; and wherein the concave indentations on the front surface indent toward the back surface and the concave indentations on the back surface indent toward the front surface, the concave indentations on the front surface and the concave indentations on the back surface reduce a thickness of the center portion;

wherein a plurality of concave indentations on the front surface are on the first wing portion and a plurality of concave indentations on the front surface are on the second wing portion;

wherein a plurality of concave indentations on the back surface are on the first wing portion and a plurality of concave indentations on the back surface are on the second wing portion; and wherein the two wing portions are nonlinear.

15. The filament of claim 14, wherein the vertex on the front surface project in a direction away from the back surface and the vertex on the back surface project in a direction away from the front surface, the vertex on the front surface and the vertex on the back surface form a larger thickness of the filament.

16. The filament of claim 14, wherein the concave indentations on the front surface and the back surface extend from the first end to a point between the first end and the second end.

* * * * *